US009022189B2

(12) United States Patent
Saito et al.

(10) Patent No.: US 9,022,189 B2
(45) Date of Patent: May 5, 2015

(54) CASK CUSHIONING BODY

(75) Inventors: Yuichi Saito, Tokyo (JP); Junichi Kishimoto, Tokyo (JP); Tadashi Kimura, Tokyo (JP); Akio Kitada, Tokyo (JP); Hiroki Tamaki, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 253 days.

(21) Appl. No.: 13/701,073

(22) PCT Filed: Jun. 28, 2011

(86) PCT No.: PCT/JP2011/064736

§ 371 (c)(1),
(2), (4) Date: Nov. 30, 2012

(87) PCT Pub. No.: WO2012/002353

PCT Pub. Date: Jan. 5, 2012

(65) Prior Publication Data

US 2013/0068578 A1 Mar. 21, 2013

(30) Foreign Application Priority Data

Jul. 2, 2010 (JP) ..... 2010-152487

(51) Int. Cl.

| | |
|---|---|
| ***F16F 7/12*** | (2006.01) |
| ***G21F 5/08*** | (2006.01) |
| ***G21F 9/36*** | (2006.01) |

(52) U.S. Cl.

CPC ... *G21F 5/08* (2013.01); *G21F 9/36* (2013.01)

(58) Field of Classification Search

CPC ..... G21F 5/08; G21F 9/36; F16F 7/12; B65D 5/5016

USPC ..... 188/377, 371, 376; 206/521, 586, 588, 206/591, 592; 376/272

See application file for complete search history.

(56) References Cited

U.S. PATENT DOCUMENTS 4,116,337 A * 9/1978 Backus ..... 206/591
4,190,160 A * 2/1980 Andersen et al. ..... 206/591

(Continued)

FOREIGN PATENT DOCUMENTS

GB 1 496 846 A 1/1978
JP 52-067499 A 6/1977

(Continued)

OTHER PUBLICATIONS

English Translation of Written Opinion of the International Searching Authority dated Jul. 26, 2013, corresponding to Application No. PCT/JP2011/064736. (6 pages).

(Continued)

*Primary Examiner* — Pamela Rodriguez
(74) *Attorney, Agent, or Firm* — Westerman, Hattori, Daniels & Adrian, LLP

(57) ABSTRACT

A cask cushioning body includes an end-surface side member (2) in which a plurality of plates (21, 22) made of steel are formed at a distance between plate surfaces of the plates (21, 22) that face each other, and in which the plate surfaces of the plates (21, 22) are arranged along an end surface (100*a*) of a cask (100), and a circumferential-surface side member (3) that forms a cylindrical body (31) made of steel, one end of which is connected to a periphery of the end-surface side member (2), and that is arranged along an end-portion outer-circumferential surface (100*b*), wherein an impact absorber (4) that absorbs an impact by deforming is provided outside of the end-surface side member (2) and the circumferential-surface side member (3).

11 Claims, 7 Drawing Sheets

(56) References Cited

U.S. PATENT DOCUMENTS

| | | | | |
|---|---|---|---|---|
| 4,423,802 | A * | 1/1984 | Botzem et al. | 188/377 |
| 4,815,605 | A * | 3/1989 | Brissier et al. | 206/523 |
| 6,234,311 | B1 * | 5/2001 | Francois | 206/521 |
| 7,327,821 | B2 * | 2/2008 | Ishihara et al. | 376/272 |
| 2007/0108086 | A1 | 5/2007 | Tamaki et al. | |
| 2012/0037632 | A1 * | 2/2012 | Singh et al. | 220/367.1 |

FOREIGN PATENT DOCUMENTS

| | | | |
|---|---|---|---|
| JP | 2004-309235 | A * | 4/2003 |
| JP | 2005-321304 | A * | 5/2004 |
| JP | 2004-309235 | A | 11/2004 |
| JP | 2005-321304 | A | 11/2005 |
| JP | 2008-233098 | A | 10/2008 |

OTHER PUBLICATIONS

International Search Report of PCT/JP2011/064736, mailing date Jul. 26, 2011.

Written Opinion of PCT/JP2011/064736, mailing date Jul. 26, 2011.

* cited by examiner

CASK CUSHIONING BODY

FIELD

The present invention relates to a cushioning body attached to a cask.

BACKGROUND

At a final stage of a nuclear fuel cycle, spent fuel (a radioactive material) contains a highly radioactive material and is cooled in a cooling pit of a nuclear power plant for a predetermined period of time because of the need of thermally cooling the spent fuel after the occurrence of decay heat to the radioactive material. The spent fuel is then stored in a cask that is a container, transported to an intermediate storage facility, a reprocessing plant, or the like by a transport method such as a truck, and stored or processed at the facility or the like. The spent fuel is hereinafter referred to as "spent fuel assemblies", because the spent fuel is normally stored in the cask that serves as a container in a state of fuel assemblies.

Generally, the cask is configured to include a main body having one end that is open and the other end that is closed, resin that is provided on the outer circumference of this main body and that is a neutron shield, an outer shell provided on the outer circumference of this resin, a basket that is arranged within the main body and that accommodates the spent fuel assemblies, and a primary lid and a secondary lid that are fixed to one end of the main body.

As described above, the cask stores therein the spent fuel assemblies, and therefore it is necessary to keep the cask shielded, subcritical, and hermetically sealed. Therefore, during the transport of casks, the casks are protected with the both ends of each cask covered with a cask cushioning body. Even if the casks are subjected to drop or the like, the shielding, subcritical, and the hermetically sealing performances of the casks are prevented from being degraded.

Conventionally, there is an example of such cask cushioning body disclosed in Patent Literature 1. This conventional cask cushioning body includes a housing having a hollow interior, and a cushioning material (such as wood) with which the interior of the housing is filled, and partitions made of metal plates that independently partition the cushioning material are provided in the interior of the housing. The partitions are provided horizontally to the height direction of the housing.

CITATION LIST

Patent Literature

Patent Literature 1: Japanese Patent Application Laid-open No. 2005-321304

SUMMARY

Technical Problem

In the cask cushioning body described in Patent Literature 1 mentioned above, the steel housing serves as the outer shell of the cushioning body, and is abutted on the ends of the cask and arranged on the surface of the cask in a state of being fixed to the cask. However, the conventional cask cushioning body has the following problems. The impact generated when the cask drops deforms the impact absorber such as the wood charged into the cushioning body and the impact absorber absorbs the impact. Depending on drop conditions, the impact even deforms the housing, the deformed housing abuts on the lid or the side surface of the cask, a local load is applied to the cask, and the impact is thereby transferred to the cask. As a result, it is impossible to sufficiently reduce the load on the cask, particularly on the lid in all assumable cask drop events. While a metal gasket or the like keeps the hermetically sealing performance of the lid, there is a probability that the impact exceeds a follow-up deformation permissible amount and deforms the metal gasket, which makes it impossible to keep a sufficient hermetically sealing performance.

The present invention has been achieved to solve the above problems, and an object of the present invention is to provide a cask cushioning body that can exhibit an improved impact absorbing performance in various assumable drop events.

Solution to Problem

According to an aspect of the present invention, a cask cushioning body attached to both ends of a cask storing therein spent fuel and absorbing an impact applied to the cask, includes: an end-surface side member in which a plurality of plates made of steel are formed at a distance between plate surfaces of the plates that face each other, and in which the plate surfaces of the plates are arranged along an end surface of the cask; and a circumferential-surface side member that forms a cylindrical body made of the steel, one end of which is connected to a periphery of the end-surface side member, and that is arranged along an end-portion outer-circumferential surface of the cask. An impact absorber that absorbs the impact by deforming is provided outside of the end-surface side member and the circumferential-surface side member.

According to the cask cushioning body, at the time of a drop or an impact, the end-surface side member made of steel does not have a large deformation while the outer impact absorber deforms and absorbs the impact. Accordingly, a large deformation does not cause the end-surface side member to abut on the lid and an impact load that possibly prevents the hermetically sealing performance of the cask from being kept is not transferred to the cask. Therefore, it is possible to reduce a local load on the end surface of the cask. Furthermore, at the time of the drop or the impact, the circumferential-surface side member does not have a large deformation while the outer impact absorber deforms and absorbs the impact. Further, on the lid side, it is possible to prevent a positional deviation of the lid, and to keep the hermetically sealing performance by the metal gasket arranged between the lid and the main body. Accordingly, a large deformation does not cause the circumferential-surface side member to abut on the end-portion outer-circumferential surface of the cask and the impact load that possibly prevents the hermetically sealing performance of the cask from being kept is not transferred to the cask. Therefore, it is possible to reduce a local load on the end-portion outer-circumferential surface of the cask.

Advantageously, in the cask cushioning body, the end-surface side member includes a plurality of end-surface reinforcing members provided to connect the plates to each other.

The cask cushioning body can realize a reduction in the load on the end surface of the cask because the end-surface reinforcing members make it more difficult to deform the end-surface side member.

Advantageously, in the cask cushioning body, an opening is formed in a central portion of the plates other than at least one plate of the end-surface side member, and the end-surface side member includes a plurality of central reinforcing members in a region opened by the opening between the plate and the other plate.

The cask cushioning body can realize a reduction in the local load on the central portion of the end surface of the cask by the central reinforcing members when a bar member penetrates the impact absorber.

Advantageously, in the cask cushioning body, the impact absorber is inserted into a region surrounded by the central reinforcing members and the plate provided with the central reinforcing members.

The cask cushioning body can ensure attaining an impact absorbing effect of the impact absorber because a positional deviation of the impact absorber is prevented when the impact absorber absorbs the impact by allowing portions in which the central reinforcing members are provided to hold the impact absorber.

Advantageously, in the cask cushioning body, the circumferential-surface side member includes a protruding portion in which peripheries of the plates in the end-surface side member protrude outward of the cylindrical body over an entire circumference of one end of the cylindrical body, a flange portion protruding outward over an entire circumference of other end of the cylindrical body, and a plurality of circumferential-surface reinforcing members connecting the protruding portion to the flange portion, and arranged on an outside surface of the cylindrical body.

The cask cushioning body can realize a further reduction in the local load on the end-portion outer-circumferential surface of the cask because the circumferential-surface reinforcing members make it more difficult to deform the circumferential-surface side member.

Advantageously, in the cask cushioning body, the impact absorber is inserted into a region surrounded by the protruding portion, the flange portion, and the circumferential-surface reinforcing members.

The cask cushioning body can ensure attaining the impact absorbing effect of the impact absorber because the positional deviation of the impact absorber is prevented when the impact absorber absorbs the impact by allowing the protruding portion, the flange portion, and the circumferential-surface reinforcing members to hold the impact absorber.

Advantageously, in the cask cushioning body, a region of the end-surface side member in which the plates face each other covers a bolt for fixing a lid of the cask.

The cask cushioning body can ensure maintaining a fastening force of the lid by reducing the concentration of a load on the bolt for fixing the lid of the cask and by preventing damage of the bolt, and can prevent the positional deviation of the lid when the bar member penetrates the impact absorber. Therefore, it is possible to keep the hermetically sealing performance by the metal gasket arranged between the lid and the main body.

Advantageously, in the cask cushioning body, the region of the end-surface side member in which the plates face each other covers an air-supply/exhaust, water-feed/drainage or pressure monitoring unit provided on the lid.

The cask cushioning body can keep the hermetic sealing performance by covering of the air-supply/exhaust, water-feed/drainage or pressure monitoring unit by reducing the concentration of a load on the air-supply/exhaust, water-feed/drainage or pressure monitoring unit provided on the lid of the cask.

Advantageously, in the cask cushioning body, an impact absorbing material that absorbs the impact by deforming is filled in the end-surface side member between regions in which the plates face each other.

The cask cushioning body can absorb the impact (particularly, a high frequency impact) applied to the plate when the bar penetrates the impact absorber.

Advantageously, in the cask cushioning body, the cask cushioning body is formed so that a size between an outer circumferential surface of the lid constituting the cask and an inner circumferential surface of the circumferential-surface side member is larger than a size between an outer circumferential surface of a main body of the cask to which the lid is fixed and the inner circumferential surface of the circumferential-surface side member.

The cask cushioning body can reduce the impact applied to the lid and can further prevent the circumferential-surface side member from abutting on the lid and the impact from being transferred to the lid by causing the circumferential-surface side member and the main body of the cask to receive the impact from the outer circumferential side, can prevent the positional deviation of the lid, and can keep the hermetically sealing performance by the metal gasket arranged between the lid and the main body.

Advantageously, in the cask cushioning body, the impact absorber is formed by a combination of a plurality of wood blocks, and the impact absorber includes a first impact absorber group that is provided along a circumference of other end of the circumferential-surface side member, and that is made of a first material that absorbs the impact in a direction parallel to the end surface of the cask, a second impact absorber group that is provided around one end of the circumferential-surface side member, along the outer circumference of the end-surface side member, and adjacent to the first impact absorber group, and that is made of a second material that is lower in a compression strength than the first material and that absorbs the impact in the direction parallel to the end surface of the cask, a third impact absorber group that is provided in an external corner of the impact absorber along the outer circumference of the end-surface side member and adjacent to the second impact absorber group, and that is made of a third material that is lower in the compression strength than the second material and that absorbs the impact in a direction orthogonal to or inclined with respect to the end surface of the cask, a fourth impact absorber group that is provided along inner circumferences of the second and third impact absorber groups and adjacent to the second and third impact absorber groups, and that is made of the third material that absorbs the impact in the direction orthogonal to the end surface of the cask, and a fifth impact absorber group that is provided inside of a circumference of the fourth impact absorber group, and that is made of the third material that absorbs the impact in the direction parallel to the end surface of the cask.

The cask cushioning body can appropriately absorb the impact of the drop or collision in assumable drop events of the cask by the impact absorber groups in addition to effects of the end-surface side member and circumferential-surface side member described above.

Advantageously, in the cask cushioning body, a mounting hole into which a bolt for fixing the cushioning body to the cask is inserted is provided in the impact absorber, and the mounting hole is expandable and contractable in a depth direction of the mounting hole.

According to the cask cushioning body, it is possible to suppress a sudden increase in an impact load caused by deformations of the mounting hole when the impact absorber starts deforming at the time of the vertical drop or vertical collision of the cask. As a result, it is possible to suppress an excessive force from acting on the bolt that fixes the lid to the main body at the time of the vertical drop or vertical collision of the cask, thereby keeping the hermetically sealing performance by the metal gasket.

Advantageous Effects of Invention

According to the present invention, the cask cushioning body that can exhibit an improved impact absorbing performance in various assumable drop events.

DESCRIPTION OF EMBODIMENTS

Exemplary embodiments of the present invention will be explained below in detail with reference to the accompanying drawings. The present invention is not limited to the embodiments. In addition, constituent elements in the following embodiments include those that can be replaced and easily anticipated by persons skilled in the art, or that are substantially equivalent.

Figure 1:
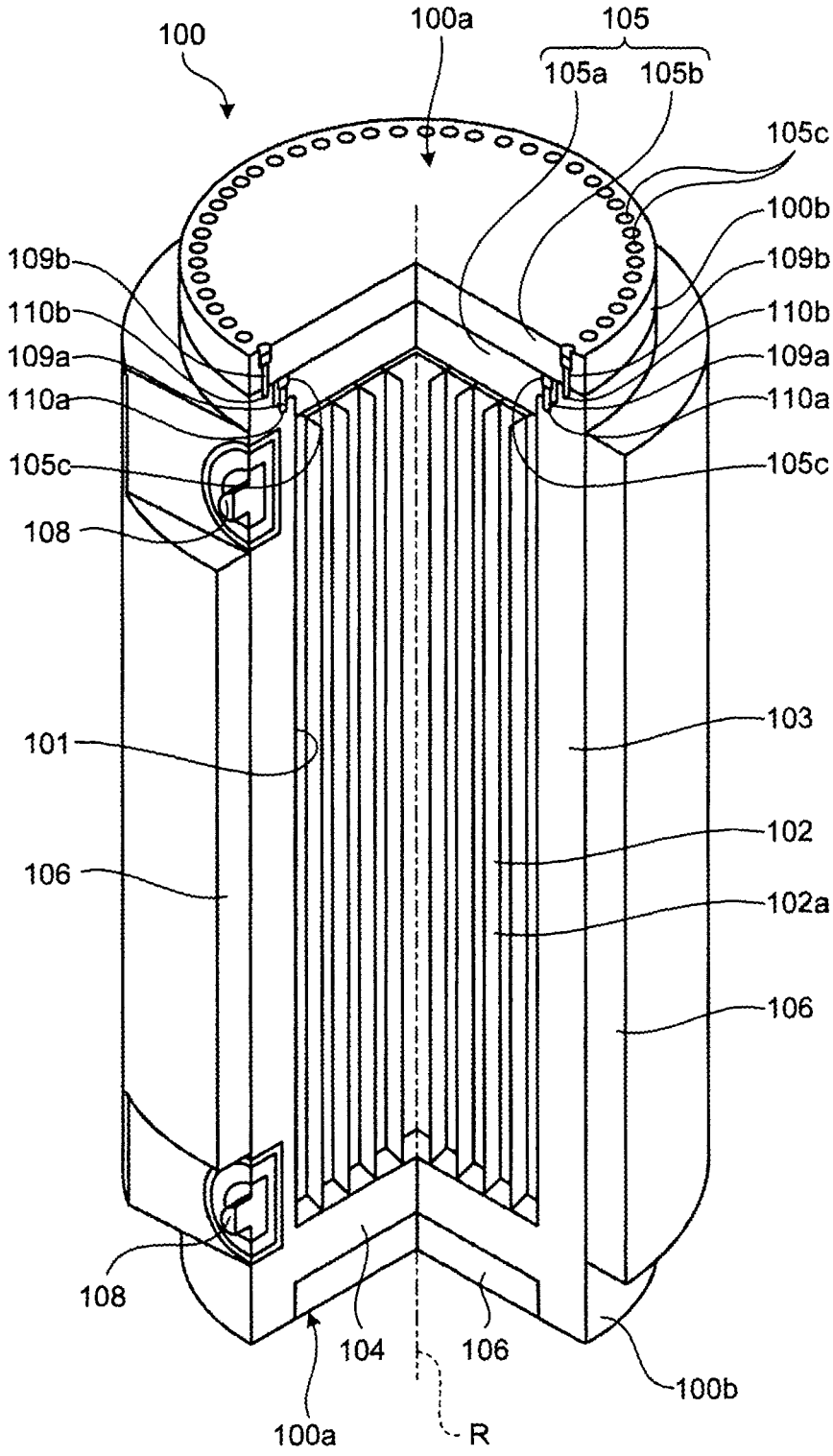
FIG. 1 is a partially exploded perspective view of a cask to which a cushioning body according to an embodiment of the present invention is applied.
Figure 2:
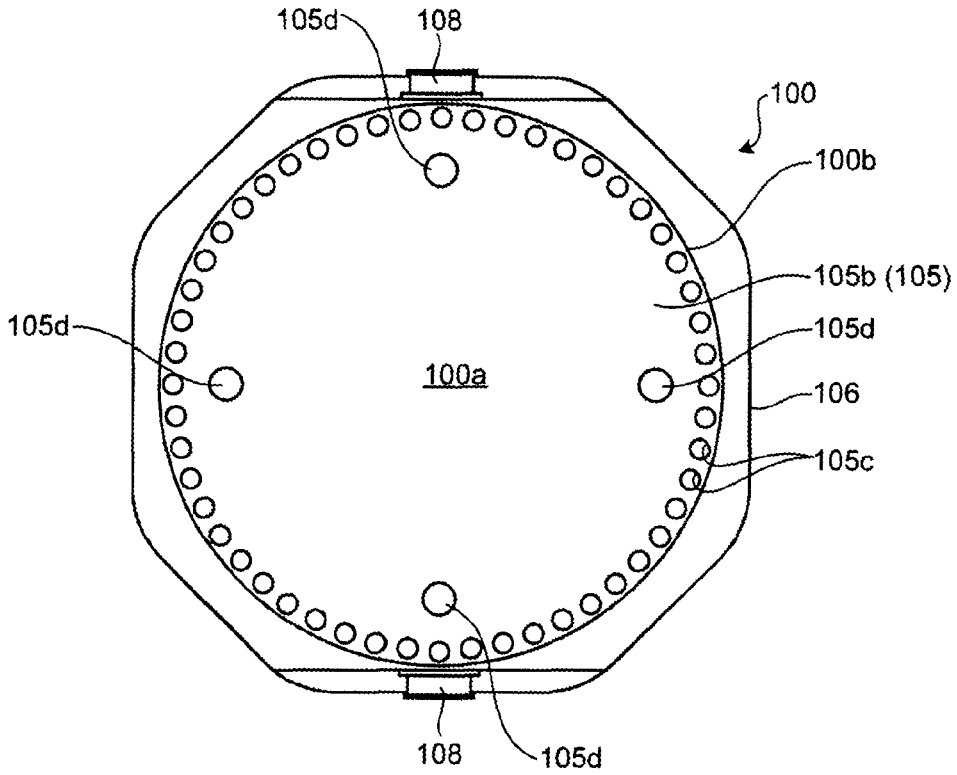
FIG. 2 is a plan view of the cask shown in FIG. 1.
Figure 3:
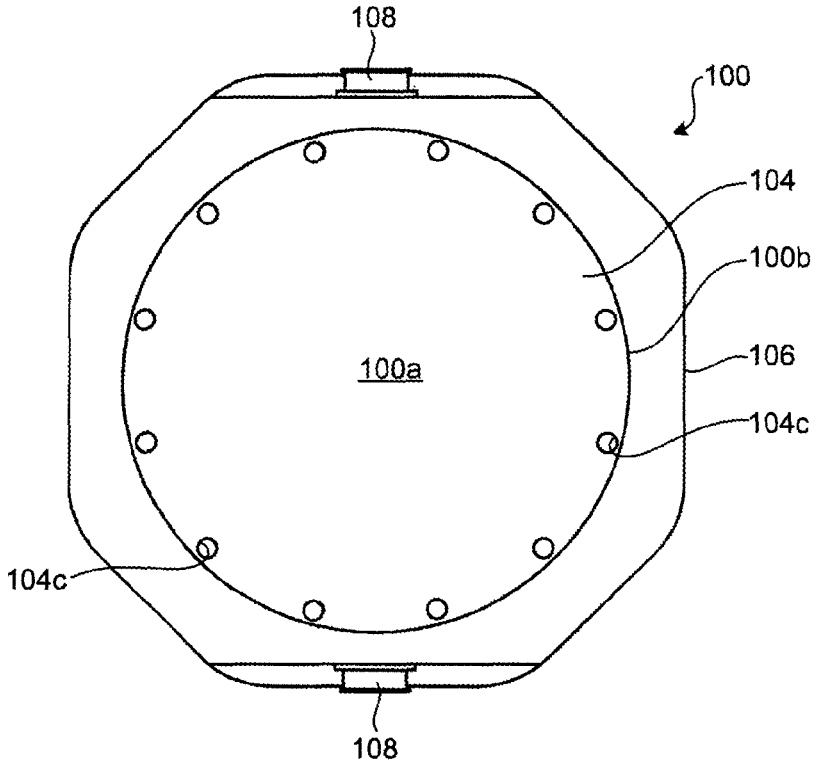
FIG. 3 is a bottom view of the cask shown in FIG. 1.

FIG. 1 is a partially exploded perspective view of a cask to which a cushioning body according to an embodiment of the present invention is applied, FIG. 2 is a plan view of the cask shown in FIG. 1, and FIG. 3 is a bottom view of the cask shown in FIG. 1.

As shown in FIGS. 1 to 3, a cask 100 storing therein radioactive materials is formed into a generally cylindrical shape. The cask 100 includes a cavity 101, a basket 102, a main body 103 serving as a cask main body, a bottom part 104, a lid 105, and a neutron shield 106.

The cavity 101 is formed within the cask 100. The cavity 101 is a space surrounded by the main body 103, the bottom part 104, and the lid 105. The basket 102 is provided within the cask 100. The basket 102 includes cells 102*a* that accommodate spent fuel assemblies that are spent fuel. For example, the basket 102 is made of an aluminum compound material to which powder of a material having a neutron absorption performance is added. An interior of the cavity 101 is formed in conformity with an outer circumferential shape of the basket 102. Alternatively, the cavity 101 can be formed into a simple cylindrical shape, and spacers excellent in a heat transfer performance can be arranged in gaps between the cavity 101 and the basket 102 that are unavailable as the cells 102*a*.

The main body 103 is formed into a generally cylindrical shape. The bottom part 104 is connected to a lower end (the other end) of the main body 103 by welding. The lid 105 is provided on an opening end of an upper portion (one end) of the main body 103. Trunnions 108 are fixed to an exterior of the main body 103. The trunnions 108 function as lifting tools for lifting the cask 100 by a lifting device such as a crane. The neutron shield 106 is filled in surroundings of the main body 103. The neutron shield 106 is a polymer material that contains hydrogen in large amounts and realizes a neutron shielding function. Boron or boron-compound-added resin is typically used as a neutron absorbing agent of the neutron shield 106. This can improve the neutron shielding function of the main body 103. Furthermore, the bottom part 104 is provided to protrude cylindrically from a bottom of the main body 103, and the neutron shield 106 is filled in an interior of the bottom part 104, thereby improving the neutron shielding function of the bottom part 104. A plurality of bolt holes 104*c* with which bolts 7 for attaching the cushioning body according to the present embodiment to the cask 100 are threaded are provided circumferentially at a bottom of the bottom part 104, as shown in FIG. 3.

The lid 105 closes the opening end of the main body 103 that is opposite to the bottom part 104. The lid 105 is configured to include a primary lid 105*a* and a secondary lid 105*b*. The primary lid 105*a* is made of carbon steel or stainless steel that shields γ rays and formed into a disk shape. The secondary lid 105*b* appears on an exterior of the cask 100 while covering the primary lid 105*a*. Similarly to the primary lid 105*a*, the secondary lid 105*b* is made of carbon steel or stainless steel that shields γ rays and formed into a disk shape. Alternatively, the neutron shielding function of the primary lid 105*a* can be improved by filling the neutron shield 106 in the primary lid 105*a*.

The primary lid 105*a* and the secondary lid 105*b* are attached to the main body 103 by bolts 109*a* and 109*b* made of carbon steel or stainless steel. Therefore, a plurality of insertion holes 105*c* into which the bolts 109*a* and 109*b* are inserted are formed circumferentially on the primary lid 105*a* and the secondary lid 105*b*. On the other hand, a plurality of bolt holes 110*a* and 110*b* into which the bolts 109*a* and 109*b* are threaded are formed circumferentially on the main body 103 so as to correspond to the number of the insertion holes 105*c*. Some of the insertion holes 105*c* (in the present embodiment, twelve) of the secondary lid 105*b* that appears on the exterior of the cask 100 are provided to insert the bolts 7 for attaching a cushioning body 1 to the cask 100, and some of the bolt holes 110*b* (in the present embodiment, twelve) are also provided to tighten the bolts 7.

As shown in FIG. 2, a plurality (in the present embodiment, four) of air-supply/exhaust, water-feed/drainage or pressure monitoring units 105*d* are provided on the lid 105 (the primary lid 105*a* and the secondary lid 105*b*). The air-supply/exhaust, water-feed/drainage or pressure monitoring units 105*d* fill feed/drainage water or helium gas to or from the cavity 101 into the cavity 101 and check pressure of the cavity 101 while attaching the lid 105 to the main body 103. Each of the air-supply/exhaust, water-feed/drainage or pressure monitoring units 105*d* is configured to include a hole that penetrates the lid 105 (the primary lid 105*a* and the secondary lid 105*b*) and a cover that closes the hole by locating a plug or the like in the hole.

Although not shown in FIG. 2, a metal gasket is provided between the primary lid 105*a* and the main body 103. Furthermore, although not shown in FIG. 2, metal gaskets are provided between the secondary lid 105*b* and the main body 103 and between the lid 105 (the primary lid 105*a* and the secondary lid 105*b*) and the air-supply/exhaust, water-feed/drainage or pressure monitoring units 105*d*, respectively. The metal gasket secures a hermetically sealing performance between the primary lid 105*a* and the main body 103. Further, the metal gasket secures the hermetically sealing performance between the secondary lid 105*b* and the main body 103. In addition, the metal gasket secures the hermetically sealing performance between the air-supply/exhaust, water-feed/drainage or pressure monitoring units 105*d* and the main body 103.

Figure 4:
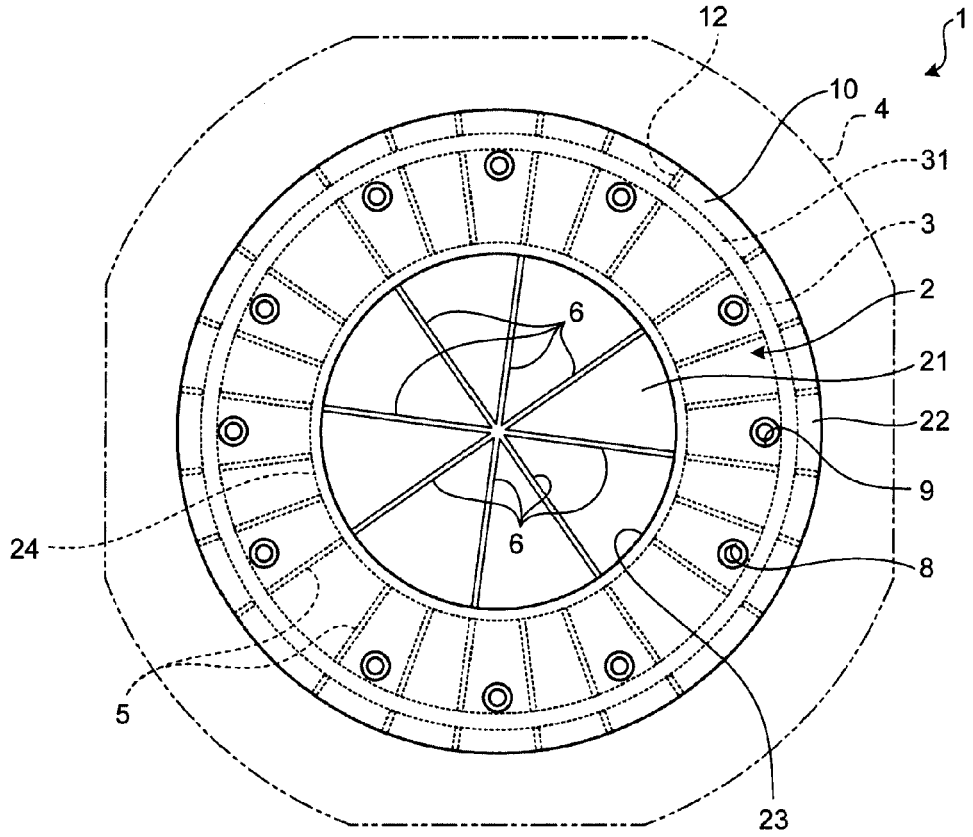
FIG. 4 is a plan view of the cushioning body according to the embodiment of the present invention.
Figure 5:
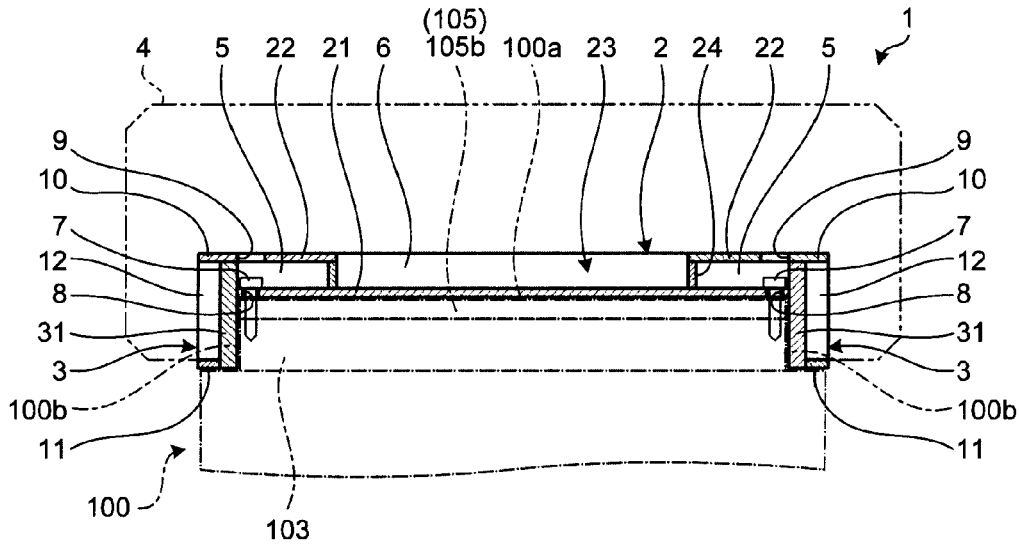
FIG. 5 is a cross-sectional side view of the cushioning body according to the embodiment of the present invention.
Figure 6:
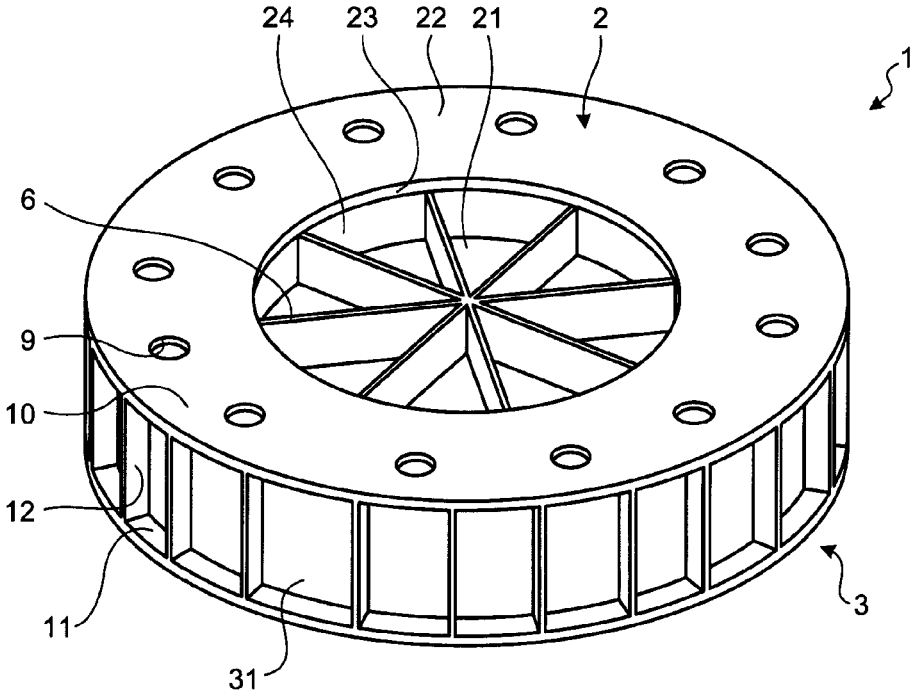
FIG. 6 is a perspective plan view of the cushioning body according to the embodiment of the present invention.
Figure 7:
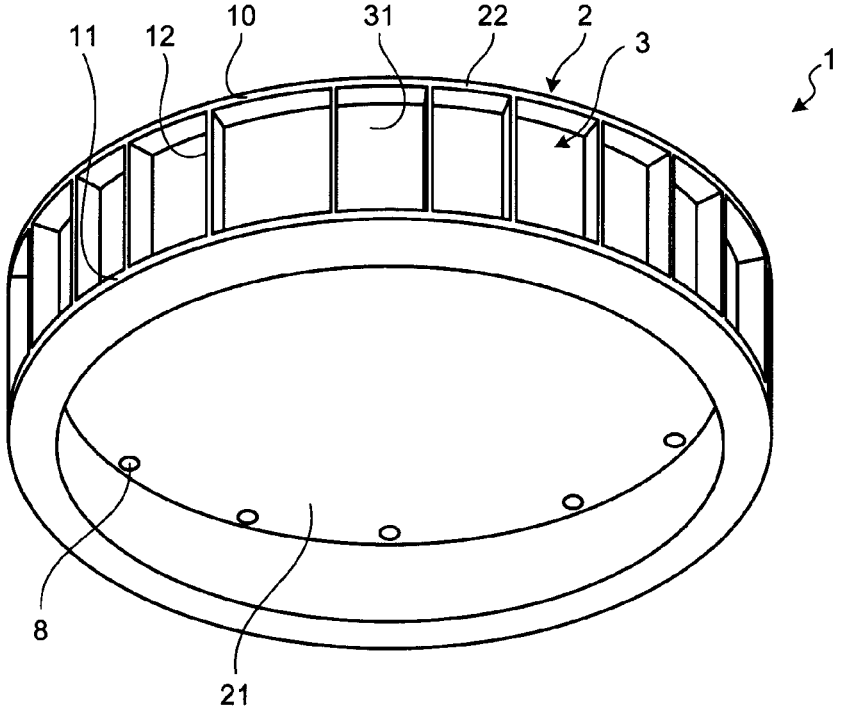
FIG. 7 is a perspective bottom view of the cushioning body according to the embodiment of the present invention.

FIG. 4 is a plan view of the cushioning body according to the present embodiment, FIG. 5 is a cross-sectional side view of the cushioning body according to the present embodiment, FIG. 6 is a perspective plan view of the cushioning body according to the present embodiment, and FIG. 7 is a perspective bottom view of the cushioning body according to the present embodiment.

As shown in FIGS. 4 to 7, the cushioning body 1 applied to the cask 100 described above is attached to both ends of the cask 100 that stores therein the spent fuel assemblies, that is, an end near the lid 105 (lid-105 side end) and that near the bottom part 104 (bottom-part-104 side end), and absorbs impact applied to the cask 100. The cushioning body 1 is configured to include an end-surface side member 2, a circumferential-surface side member 3, and an impact absorber 4. In the cushioning body 1 according to the present embodiment, constituent elements attached to the lid-105 side end are identical to those attached to the bottom-part-104 side end. Therefore, only the constituent elements attached to the lid-105 side end are explained below and explanations of those attached to the bottom-part-104 side end will be omitted.

The end-surface side member 2 is arranged along each of end surfaces 100*a* of the cask 100. The end surfaces 100*a* of the cask 100 are an upper surface of the lid 105 (the secondary lid 105*b*) and the bottom of the bottom part 104. The end-surface side member 2 includes a plurality (in the present embodiment, two) of plates 21 and 22 made of steel. Each of the plates 21 and 22 is formed into a circular shape equal to or slightly larger than a circular shape of the secondary lid 105*b* in a size. Furthermore, the plates 21 and 22 are provided to face each other at a distance kept therebetween, and plate surfaces of the plates 21 and 22 are arranged along each of the end surfaces 100*a* of the cask 100. In the present embodiment, the plate 21 is arranged to face the end surface 100*a* of the cask, and the plate 22 is arranged to be away from the end surface 100*a* of the cask 100 because of the distance from the plate 21.

In a case of the end-surface side member 2, at least one plate (the plate 21 in the present embodiment; however, the plate 22 can serve as the plate) covers entirely the end surface 100*a* of the cask 100. A circular opening 23 is formed in a central portion of the plate other than the at-least-one plate (the plate 22 in the present embodiment; however, the plate 21 can serve as the other plate). A partition member 24 is provided on an edge of the opening 23. The partition member 24 is made of steel, and formed into a cylindrical shape along a circular shape of the opening 23. The partition member 24 is arranged between the plates 21 and 22, thereby partitioning a region between the plates 21 and 22 into a region that the plates 21 and 22 face and a region near the opening 23. The opening 23 is not necessarily formed in all the plates 21 and 22. The partition member 24 is not arranged if the opening 23 is not formed.

Furthermore, a plurality of end-surface reinforcing members 5 connecting the plate 21 to the plate 22 are provided in the end-surface side member 2. The end-surface reinforcing members 5 are ribs made of steel and provided to extend radially around a center of circles of the plates 21 and 22. In the cushioning body 1 according to the present embodiment, because of the formation of the opening 23 in the central portion of the plate 22, the end-surface reinforcing members 5 include portions other than the openings 23 and are provided at which the plate surfaces of the plates 21 and 22 face each other between the partition member 24 and the circumferential-surface side member 3. In contrast, if the openings 23 are not formed in all plates 21 and 22, the end-surface reinforcing members 5 include central portions and are provided at which the plate surfaces of the plates 21 and 22 face each other.

Further, when the opening 23 is provided, a plurality of central reinforcing members 6 are provided in regions opened by the opening 23 and shared by the other plate. The central reinforcing members 6 are ribs made of steel and provided to extend radially around the center of the circles of the plates 21 and 22.

Furthermore, in the end-surface side member 2, locking holes 8 that lock the bolts 7 threaded with the bolt holes 110*b* of the cask 100 are provided in the plate 21 closest to the end surface 100*a* of the cask 100, and insertion holes 9 into which the bolts 7 are inserted are provided in the other plate 22. That is, the end-surface side member 2 is attached to the cask 100 by fixing the plate 21 to the cask 100 by the bolts 7.

The circumferential-surface side member 3 is arranged along each of end-portion outer-circumferential surfaces 100*b* of the cask 100. The end-portion outer-circumferential surfaces 100*b* are an outer circumferential surface of the lid 105 (the secondary lid 105*b*) and that of the bottom part 104. The circumferential-surface side member 3 includes a cylindrical body 31 made of steel and having a cylindrical shape. One end of the cylindrical body 31 is connected to an edge of the end-surface side member 2 by welding. Specifically, one end of the cylindrical body 31 is connected to the plate surface of the plate 22 and connected to a periphery of the plate 21. With this configuration, the circumferential-surface side member 3 covers the end-portion outer-circumferential surface 100*b* of the cask 100 in a state of attaching the end-surface side member 2 to the end surface 100*a* of the cask 100. Note that steel thicker than the other constituent elements made of steel is used as a material of the cylindrical body 31.

Because one end of the cylindrical body 31 is connected to the plate surface of the plate 22, the circumferential-surface side member 3 is provided with a protruding portion 10 in which the periphery of the plate 22 in the end-surface side member 2 protrudes outward of the cylindrical body 31 over an entire circumference of one end of the cylindrical body 31. Furthermore, the circumferential-surface side member 3 is provided with a flange portion 11 protruding outward over an entire circumference of the other end of the cylindrical body 31 and made of steel. Further, the circumferential-surface side member 3 is provided with a plurality of circumferential-surface reinforcing members 12 connecting the protruding portion 10 to the flange portion 11 and arranged on an outside surface of the cylindrical body 31. The circumferential-surface reinforcing members 12 are ribs made of steel and provided to extend on an outer circumferential surface of the cylindrical body 31 radially around the circles of the plates 21 and 22.

The impact absorber 4 is attached to an exterior of the end-surface side member 2 described above and an exterior of the circumferential-surface side member 3 described above, and arranged on an outermost side of the entire cushioning body 1. The impact absorber 4 absorbs the impact generated when the cask 100 drops or collides by deforming, and is made of wood, for example.

The impact absorber 4 is attached to the end-surface side member 2 along an outside plate surface of the outermost plate 22. When the opening 23 is formed in the outermost plate 22, the impact absorber 4 is attached to the end-surface side member 2 while being inserted into a region of the end-surface side member 2 that is within the opening 23 and that is formed by the other plate 21, the partition member 24, and the central reinforcing members 6.

The impact absorber 4 is attached to the circumferential-surface side member 3 while a part of the impact absorber 4 is inserted into a region formed by the outer circumferential surface of the cylindrical body 31, the protruding portion 10, the flange portion 11, and the circumferential-surface reinforcing members 12.

Furthermore, the impact absorber 4 is attached not only to the end-surface side member 2 and the circumferential-surface side member 3 but also to angular portions outside of external corners formed by the end-surface side member 2 and the circumferential-surface side member 3. Therefore, the impact absorber 4 is attached to outside of the end-surface side member 2 and that of the circumferential-surface side member 3, and arranged on the outermost side of the cushioning body 1. The cushioning body 1 protrudes outward of both end surfaces of the cask 100 and protrudes outward of an outside diameter of the neutron shield 106 that is provided around the main body 103 of the cask 100.

The cask cushioning body according to the present embodiment configured as described above includes the end-surface side member 2 in which a plurality of plates 21 and 22 made of steel are formed at a distance between the plate surfaces of the plates 21 and 22 that face each other, and in which these plate surfaces of the plates 21 and 22 are arranged along the end surface 100*a* of the cask 100, and the circumferential-surface side member 3 that forms the cylindrical body 31 made of the steel, one end of which is connected to the periphery of the end-surface side member 2, and that is arranged along the end-portion outer-circumferential surface 100*b* of the cask 100, and the impact absorber 4 that absorbs the impact by deforming is provided outside of the end-surface side member 2 and the circumferential-surface side member 3.

A drop event with a height of drop of 9 meters (drop test I) and a drop event with a height of drop of 1 meter on an upright round bar having a diameter of 15 centimeters (drop test II) are imposed, as drop tests for demonstrating capabilities (of keeping the hermetic sealing, shielding, and subcritical performances) to withstand accident conditions of transport, on the cask 100 in Regulations for the Safe Transport of Radioactive Material, 2005 Edition, the IAEA (International Atomic Energy Agency) Safety Standard. For example, the drop events include (1) a vertical drop with the end surface 100*a* (a central axis R of the cask 100 shown in FIG. 1) oriented in a vertical direction, (2) a horizontal drop with the end surface 100*a* (the central axis R) oriented in a horizontal direction, and (3) a corner drop with the end surface 100*a* (the central axis R) oriented aslant. In recent years, the metal gasket is adopted for the use between the lid 105 and the main body 103 of the cask 100, it is important to suppress a positional deviation of the lid 105 from the main body 103, and the weight of the cask 100 increases as a result of an increase in the number of stored spent fuel assemblies. Therefore, the demand for a cushioning performance of the cushioning body 1 rises.

The cask cushioning body according to the present embodiment can exhibit the improved impact absorbing performance in the various drop events such as the assumable drop events (1) to (3) described above to which the cask 100 is subjected. Specifically, at the time of a drop or an impact, the end-surface side member 2 made of steel does not have a large deformation while the outer impact absorber 4 deforms and absorbs the impact. Therefore, a large deformation does not cause the end-surface side member 2 to abut on the lid 105 and an impact load that possibly prevents the hermetically sealing performance of the cask 100 from being kept is not transferred to the cask 100. Therefore, it is possible to reduce a local load on the end surface 100*a* of the cask 100 in the drop events (1) and (3). Furthermore, at the time of the drop or the impact, the circumferential-surface side member 3 does not have a large deformation while the outer impact absorber 4 deforms and absorbs the impact. Accordingly, a large deformation does not cause the circumferential-surface side member 3 to abut on the end-portion outer-circumferential surface 100*b* of the cask 100 and the impact load that possibly prevents the hermetically sealing performance of the cask 100 from being kept is not transferred to the cask 100. Therefore, it is possible to reduce a local load on the end-portion outer-circumferential surface 100*b* of the cask 100 in the drop event (2). Furthermore, on the lid 105 side, it is possible to prevent a positional deviation of the lid 105, and to keep the hermetically sealing performance by the metal gasket arranged between the lid 105 and the main body 103. As a result, it is possible to improve the impact absorbing performance in the assumable various events. The cylindrical body 31 of the circumferential-surface side member 3 is made of the thicker steel than the other constituent elements made of the steel. This makes it possible to attain appropriate rigidity while preventing the end-portion outer-circumferential surface 100*b* of the cask 100 on which a strict size restriction is set for the cushioning body 1 from largely protruding outward.

Furthermore, in the cask cushioning body according to the present embodiment, the end-surface side member 2 includes a plurality of end-surface reinforcing members 5 provided to connect the plates 21 and 22 to each other.

The cask cushioning body can realize a reduction in the load on the end surface 100*a* of the cask 100 because the end-surface reinforcing members 5 make it more difficult to deform the end-surface side member 2.

Further, in the cask cushioning body according to the present embodiment, the opening 23 is formed in the central portion of the plate 22 other than at least one plate of the end-surface side member 2, and the end-surface side member 2 includes a plurality of central reinforcing members 6 in the region opened by the opening 23 between the plate 21 and the other plate 21.

The cask cushioning body can realize a reduction in the local load on the central portion of the end surface 100*a* of the cask 100 by the central reinforcing members 6 when a bar member penetrates the impact absorber 4.

Furthermore, in the cask cushioning body according to the present embodiment, the impact absorber 4 is inserted into the region surrounded by the central reinforcing members 6 and the plate 21 provided with the central reinforcing members 6.

The cask cushioning body can ensure attaining an impact absorbing effect of the impact absorber 4 because a positional deviation of the impact absorber 4 is prevented when the impact absorber 4 absorbs the impact by allowing portions in which the central reinforcing members 6 are provided to hold the impact absorber 4. It is particularly possible to prevent the positional deviation of the impact absorber 4 and to ensure attaining the impact absorbing effect of the impact absorber 4 at the time of (3) the corner drop with the end surface 100*a* oriented aslant in the drop event with the height of the drop of 9 meters.

Further, in the cask cushioning body according to the present embodiment, the circumferential-surface side member 3 includes the protruding portion 10 in which the periphery of the plate 22 in the end-surface side member 2 protrudes outward of the cylindrical body 31 over the entire circumference of one end of the cylindrical body 31, the flange portion 11 protruding outward over the entire circumference of the other end of the cylindrical body 31, and a plurality of circumferential-surface reinforcing members 12 connecting the protruding portion 10 to the flange portion 11 and arranged on the outside surface of the cylindrical body 31.

The cask cushioning body can realize a further reduction in the local load on the end-portion outer-circumferential surface 100*b* of the cask 100 because the circumferential-surface reinforcing members 12 make it more difficult to deform the circumferential-surface side member 3.

Furthermore, in the cask cushioning body according to the present embodiment, the impact absorber 4 is inserted into the region surrounded by the protruding portion 10, the flange portion 11, and the circumferential-surface reinforcing members 12.

The cask cushioning body can ensure attaining the impact absorbing effect of the impact absorber 4 because the positional deviation of the impact absorber 4 is prevented when the impact absorber 4 absorbs the impact by allowing the protruding portion 10, the flange portion 11, and the circumferential-surface reinforcing members 12 to hold the impact absorber 4. It is particularly possible to prevent the positional deviation of the impact absorber 4 and to ensure attaining the impact absorbing effect of the impact absorber 4 at the time of (3) the corner drop with the end surface 100*a* oriented aslant in the drop events with the height of the drop of 9 meters.

Further, in the cask cushioning body according to the present embodiment, regions of the end-surface side member 2 in which the plurality of the plates 21 and 22 face each other cover the bolts 109*b* for fixing the lid 105 (particularly, the secondary lid 105*b*) of the cask 100.

The cask cushioning body can ensure maintaining a fastening force of the lid 105 by reducing the concentration of a load on the bolts 109*b* for fixing the lid 105 (particularly, the secondary lid 105*b*) of the cask 100 and by preventing damage of the bolts 109*b*, and can prevent the positional deviation of the lid 105 when the bar member penetrates the impact absorber 4. As a result, it is possible to keep the hermetically sealing performance by the metal gasket arranged between the lid 105 and the main body 103. It is particularly possible to reduce an excessive load on the bolts 109*b* at the time of (1) the vertical drop with the end surface 100*a* oriented in the vertical direction in the drop event with the height of drop of 1 meter on the round boar. Although not shown in the drawings, it is preferable that recesses are formed in the plate surface of the plate 21 that covers the bolts 109*b* which surface faces the bolts 109*b*. Alternatively, it is preferable that the bolts 109*b* are provided to be recessed with respect to the end surface 100*a*. These recesses can reduce the impact related to the bolts 109*b* (particularly the impact at the time of (1) the vertical drop with the end surface 100*a* oriented in the vertical direction in the drop event with the height of drop of 1 meter on the round bar).

In the cask cushioning body according to the present embodiment, the regions of the end-surface side member 2 in which the plurality of the plates 21 and 22 face each other cover the air-supply/exhaust, water-feed/drainage or pressure monitoring units 105*d* provided on the lid 105.

The cask cushioning body can keep the hermetic sealing performance by cover of the air-supply/exhaust, water-feed/drainage or pressure monitoring units 105*d* by reducing the concentration of a load on the air-supply/exhaust, water-feed/drainage or pressure monitoring units 105*d* provided on the lid 105 of the cask 100, when the bar member penetrates the impact absorber 4. It is particularly possible to reduce an excessive load on the air-supply/exhaust, water-feed/drainage or pressure monitoring units 105*d* at the time of (1) the vertical drop with the end surface 100*a* oriented in the vertical direction in the drop event with the height of drop of 1 meter on the round boar. Although not shown in the drawings, it is preferable that recesses are formed in the plate surface of the plate 21 that covers the air-supply/exhaust, water-feed/drainage or pressure monitoring units 105*d* which surface faces the air-supply/exhaust, water-feed/drainage or pressure monitoring units 105*d*. Alternatively, it is preferable that the air-supply/exhaust, water-feed/drainage or pressure monitoring units 105*d* are provided to be recessed with respect to the end surface 100*a*. These recesses can reduce the impact related to the air-supply/exhaust, water-feed/drainage or pressure monitoring units 105*d* (particularly the impact at the time of (1) the vertical drop with the end surface 100*a* oriented in the vertical direction in the drop event with the height of drop of 1 meter on the round bar).

In the cask cushioning body according to the present embodiment, the impact absorbing material that absorbs the impact by deforming is filled in the end-surface side member 2 between the regions in which the plurality of the plates 21 and 22 face each other. In this case, the impact absorbing material refers to wood, urethane foam, foam metal, or the like.

The cask cushioning body can absorb the impact (particularly, a high frequency impact) applied to the plate 22 when the bar penetrates the impact absorber 4 at the time of (1) the vertical drop with the end surface 100*a* oriented in the vertical direction in the drop event with the height of drop of 1 meter on the round bar.

Figure 8:
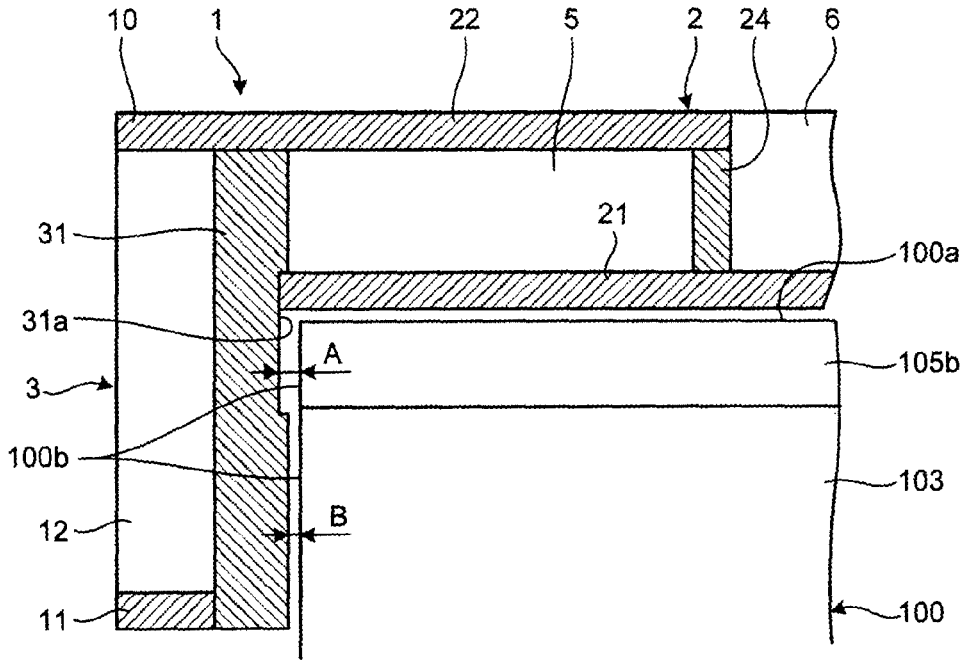
FIG. 8 is an enlarged cross-sectional side view of the cushioning body according to the embodiment of the present invention.
Figure 9:
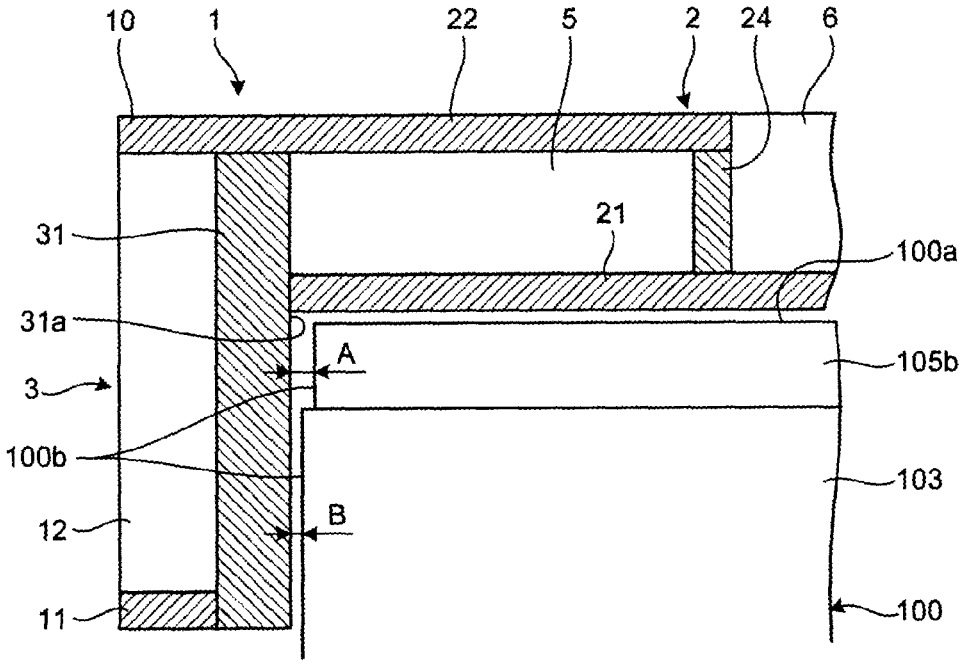
FIG. 9 is an enlarged cross-sectional side view of the cushioning body according to the embodiment of the present invention.

As shown in FIGS. 8 and 9 that are enlarged cross-sectional side views of the cushioning body according to the present embodiment, the cask cushioning body according to the present embodiment is formed so that a size A between the outer circumferential surface of the lid 105 (the secondary lid 105*b* in the present embodiment) constituting the cask 100 and an inner circumferential surface of the cylindrical body 31 of the circumferential-surface side member 3 is larger than a size B between an outer circumferential surface of the main body 103 of the cask 100 to which the lid 105 is fixed and the inner circumferential surface of the cylindrical body 31 of the circumferential-surface side member 3. Specifically, as shown in FIG. 8, a stepped portion 31*a* recessed by about 1 millimeter is provided in a portion of the cylindrical body 31 of the circumferential-surface side member 3 that faces the outer circumferential surface of the secondary lid 105*b*, and the stepped portion 31*a* is made thinner than portions of the cylindrical body 31 that face the outer circumferential surface of the main body 103. Alternatively, as shown in FIG. 9, an outside diameter of the secondary lid 105*b* is made smaller than that of the main body 103 by about 1 millimeter.

The cask cushioning body can reduce the impact applied to the lid 105 (the secondary lid 105*b*) and can further prevent the circumferential-surface side member 3 from abutting on the lid 105 (the secondary lid 105*b*) and the impact from being transferred to the lid 105 by causing the circumferential-surface side member 3 and the main body 103 of the cask 100 to receive the impact from the outer circumferential side (particularly the impact at the time of (2) the horizontal drop with the end surface 100*a* oriented in the horizontal direction). As a result, it is possible to prevent the positional deviation of the lid 105 and to keep the hermetically sealing performance by the metal gasket arranged between the lid 105 and the main body 103.

Figure 10:
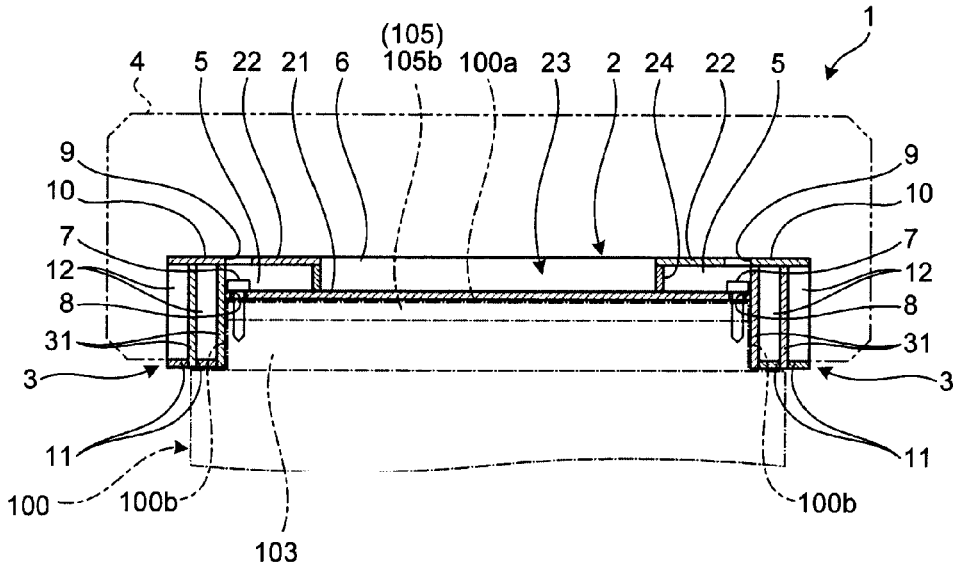
FIG. 10 is a cross-sectional side view of the cushioning body according to the embodiment of the present invention.

The cask cushioning body according to the present embodiment can be configured to provide multiple (in the present embodiment, double) cylindrical bodies 31, as shown in FIG. 10 that is a cross-sectional side view of the cushioning body according to the present embodiment. In this case, one end of each cylindrical body 31 is connected to the plate surface of the plate 21 and the protruding portion 10 is provided outward of one end of each cylindrical body 31. The flange portion 11 is provided on the other end of each cylindrical body 31. The circumferential-surface reinforcing members 12 are provided in regions formed by the respective cylindrical bodies 31, the plate 22, and the flange portions 11. The circumferential-surface reinforcing members 12 are also provided in the regions formed by the outermost cylindrical body 31, the protruding portion 10, and the flange portion 11.

The cask cushioning body can realize a further reduction in the load on the end-portion outer-circumferential surface 100*b* of the cask 100 because it is made more difficult to deform the circumferential-surface side member 3. When the multiple cylindrical bodies 31 are provided, each cylindrical body 31 is made of the steel as thick as the other constituent elements made of the steel. This makes it possible to attain appropriate rigidity while preventing the end-portion outer-circumferential surface 100*b* of the cask 100 on which a strict size restriction is set for the cushioning body 1 from largely protruding outward.

When the multiple cylindrical bodies 31 are provided, the impact absorber 4 is inserted into the region surrounded by the outermost cylindrical body 31, the protruding portion 10, the flange portion 11, and the circumferential-surface reinforcing members 12. Therefore, the cask cushioning body according to the present embodiment can ensure attaining the impact absorbing effect of the impact absorber 4 by causing the protruding portion 10, the flange portion 11, and the circumferential-surface reinforcing members 12 to hold the impact absorber 4 and by preventing the positional deviation of the impact absorber 4 when the impact absorber 4 absorbs the impact.

When the multiple cylindrical bodies 31 are provided, the impact absorbing material that absorbs the impact by deforming is filled in the region surrounded by each cylindrical body 31, the plate 22, the flange portion 11, and the circumferential-surface reinforcing members 12. In this case, the impact absorbing material refers to wood, urethane foam, foam metal, or the like. Therefore, the cask cushioning body can absorb the impact (particularly, a high frequency impact) applied to the outermost cylindrical body 31 when the bar penetrates the impact absorber 4 at the time of (2) the horizontal drop with the end surface 100*a* oriented in the horizontal direction in the drop event with the height of drop of 1 meter on the round bar.

Figure 11:
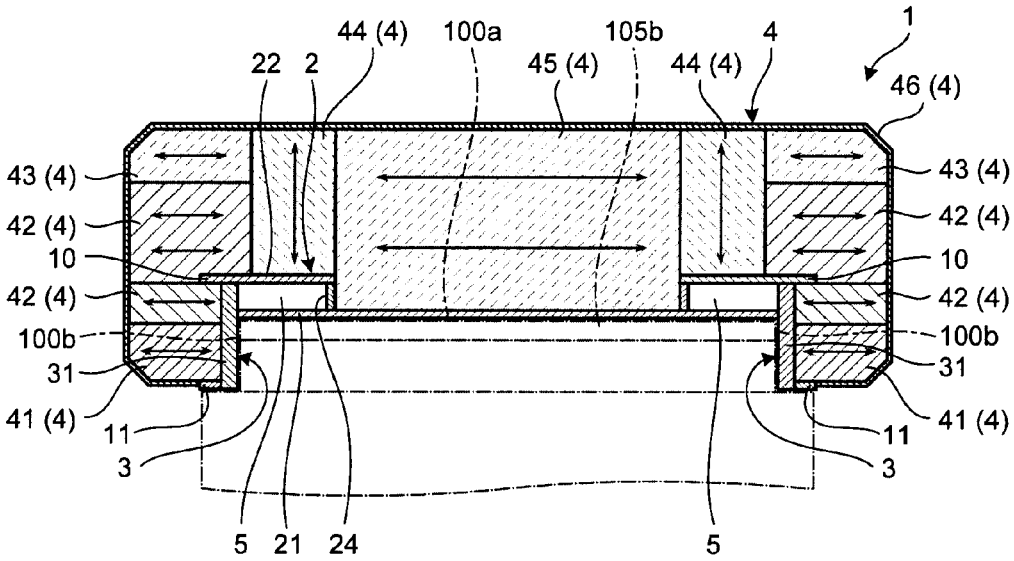
FIG. 11 is a cross-sectional side view of an impact absorber of the cushioning body according to the embodiment of the present invention.
Figure 12:
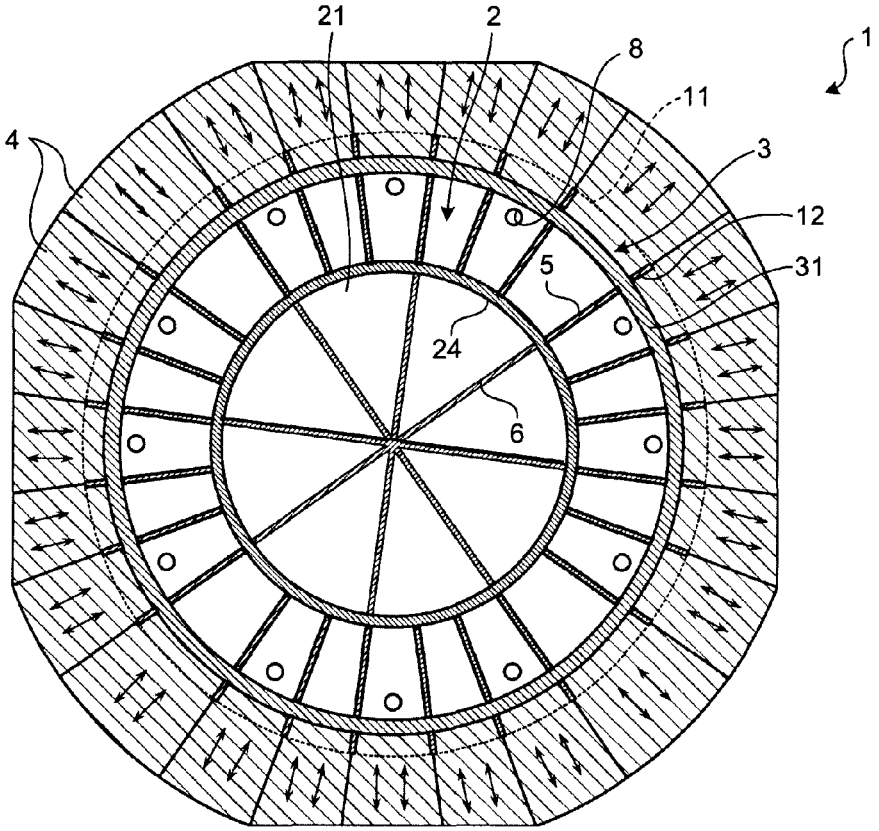
FIG. 12 is a cross-sectional plan view of the impact absorber of the cushioning body according to the embodiment of the present invention.

The impact absorber 4 in the cushioning body 1 according to the present embodiment is described. FIG. 11 is a cross-sectional side view of an impact absorber of the cushioning body according to the present embodiment, and FIG. 12 is a cross-sectional plan view of the impact absorber. In FIGS. 11 and 12, arrows indicate directions of fiber of the wood constituting the impact absorber 4.

The cushioning body 1 according to the present embodiment can further fulfill a function required as the cushioning body of the cask 100 by forming the impact absorber 4 out of the wood and arranging the impact absorber 4 while changing types of the impact absorber 4 and directions of the fiber.

As shown in FIG. 11, the impact absorber 4 is configured to include a combination of a first impact absorber group 41, a second impact absorber group 42, a third impact absorber group 43, a fourth impact absorber group 44, and a fifth impact absorber group 45. These first to fifth impact absorber groups 41 to 45 are formed by combining a plurality of wood blocks. An outermost side of the impact absorber 4 is covered with an outer shell 46.

The first impact absorber group 41 is provided along a circumference of the other end of the circumferential-surface side member 3. The first impact absorber group 41 is made of a first material that absorbs the impact in a direction parallel to the end surface 100*a* of the cask 100 by arranging the first impact absorber group 41 to set the direction of the fiber along the direction parallel to the end surface 100*a* of the cask 100. As shown in FIGS. 11 and 12, in the first impact absorber group 41, a plurality of blocks divided in a circumferential direction of the impact absorber 4 are inserted into the region surrounded by the flange portion 11 and the circumferential-surface reinforcing members 12 and held by the flange portion 11 and the circumferential-surface reinforcing members 12.

The second impact absorber group 42 is provided around one end of the circumferential-surface side member 3, along an outer circumference of the end-surface side member 2, and adjacent to the first impact absorber group 41. The second impact absorber group 42 is made of a second material having a lower compression strength than the first material and that absorbs the impact in the direction parallel to the end surface 100*a* of the cask 100 by arranging the second impact absorber group 42 to set the direction of the fiber along the direction parallel to the end surface 100*a* of the cask 100. As shown in FIGS. 11 and 12, in the second impact absorber group 42, a plurality of blocks divided in the circumferential direction of the impact absorber 4 are inserted into the region surrounded by the protruding portion 10 and the circumferential-surface reinforcing members 12 and held by the protruding portion 10 and the circumferential-surface reinforcing members 12.

The third impact absorber group 43 is provided in each external corner of the impact absorber 4 along the outer circumference of the end-surface side member 2 and adjacent to the second impact absorber group 42. The third impact absorber group 43 is made of a third material that is lower in the compression strength than the second material and that absorbs the impact in a direction orthogonal to or inclined with respect to the end surface 100*a* of the cask 100 by arranging the third impact absorber group 43 to set the direction of the fiber along the direction parallel to the end surface 100*a* of the cask 100. Although not shown in the drawings, the third impact absorber group 43 is constituted by a plurality of blocks divided in the circumferential direction of the impact absorber 4.

The fourth impact absorber group 44 is provided along inner circumferences of the second and third impact absorber groups 42 and 43 and adjacent to the second and third impact absorber groups 42 and 43. The fourth impact absorber group 44 is made of the third material that absorbs the impact in the direction orthogonal to the end surface 100*a* of the cask 100 by arranging the fourth impact absorber group 44 to set the direction of the fiber along the direction orthogonal to the end surface 100*a* of the cask 100. Although not shown in the drawings, the fourth impact absorber group 44 is constituted by a plurality of blocks divided in the circumferential direction of the impact absorber 4.

The fifth impact absorber group 45 is provided inside of a circumference of the fourth impact absorber groups 44. The fifth impact absorber group 45 is made of the third material that absorbs the impact in the direction parallel to the end surface 100*a* of the cask 100 by arranging the fifth impact absorber group 45 to set the direction of the fiber along the direction parallel to the end surface 100*a* of the cask 100. Although not shown in the drawings, the fifth impact absorber group 45 is constituted by a plurality of blocks divided in the circumferential direction of the impact absorber 4.

In the cask cushioning body according to the present embodiment, the opening 23 is formed in the central portion of the plate 22 other than at least one plate of the end-surface side member 2, and the end-surface side member 2 includes the plurality of the central reinforcing members 6 in the region opened by the opening 23 between the plate 21 and the other plate 21. The fifth impact absorber group 45 is inserted into the region surrounded by the central reinforcing members 6 and the plate 21 provided with the central reinforcing members 6.

The first material that constitutes the first impact absorber group 41 has the highest compression strength among all the materials of the impact absorber 4 and oak, for example, is used as the first material. The second material that constitutes the second impact absorber group 42 is lower in the compression strength than the first material, and red cedar, for example, is used as the second material. The third material that constitutes the third impact absorber group 43, the fourth impact absorber group 44, and the fifth impact absorber group 45 is lower in the compression strength than the second material, and balsa, for example, is used as the third material. The compression strength refers to Young's modulus or a compressive strength when the impact absorber is compressed.

The outer shell 46 is made of thinner steel than the end-surface side member 2 and the circumferential-surface side member 3, and provided along outer side surfaces of the first to fifth impact absorber groups 41 to 45 so as to cover the first to fifth impact absorber groups 41 to 45. The outer shell 46 is connected to the flange portion 11 of the circumferential-surface side member 3 by welding. The outer shell 46 protects the first to fifth impact absorber groups 41 to 45 from moist and drops of water, and absorbs the impact by deforming together with the first to fifth impact absorber groups 41 to 45 in the drop events described above.

As described above, in the cask cushioning body according to the present embodiment, the impact absorber 4 is formed by a combination of a plurality of wood blocks, and includes the first impact absorber group 41 that is provided to surround the other end of the circumferential-surface side member 3 and that is made of the first material that absorbs the impact in the direction parallel to the end surface 100*a* of the cask 100, the second impact absorber group 42 that is provided to surround one end of the circumferential-surface side member 3, along the outer circumference of the end-surface side member 2, and adjacent to the first impact absorber group 41 and that is made of the second material that is lower in the compression strength than the first material and that absorbs the impact in the direction parallel to the end surface 100*a* of the cask 100, the third impact absorber group 43 that is provided in each external corner of the impact absorber 4 along the outer circumference of the end-surface side member 2 and adjacent to the second impact absorber group 42 and that is made of a third material that is lower in the compression strength than the second material and that absorbs the impact in the direction orthogonal to or inclined with respect to the end surface 100*a* of the cask 100, the fourth impact absorber group 44 that is provided along the inner circumferences of the second and third impact absorber groups 42 and 43 and adjacent to the second and third impact absorber groups 42 and 43 and that is made of the third material that absorbs the impact in the direction orthogonal to the end surface 100*a* of the cask 100, and the fifth impact absorber group 45 that is provided inside of the circumference of the fourth impact absorber group 44 and that is made of the third material that absorbs the impact in the direction parallel to the end surface 100*a* of the cask 100.

The cask cushioning body can appropriately absorb the impact of the drop or collision in the assumable drop events of the cask 100 by the impact absorber groups 41, 42, 43, 44, and 45 in addition to effects of the end-surface side member 2 and the circumferential-surface side member 3 described above.

Figure 13:
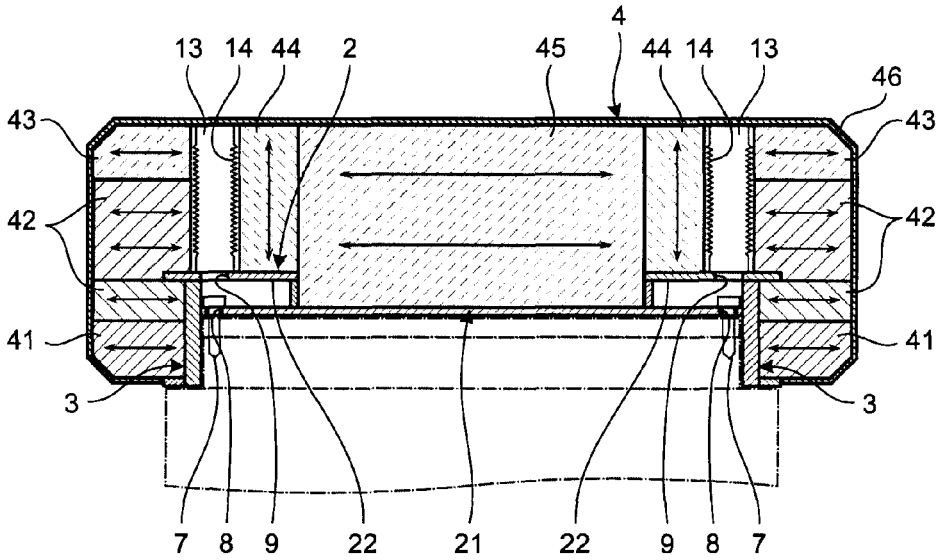
FIG. 13 is a cross-sectional side view of the impact absorber of the cushioning body according to the embodiment of the present invention in another direction.

FIG. 13 is a cross-sectional side view of the impact absorber of the cushioning body according to the present embodiment in another direction. As shown in FIG. 13, mounting holes 13 into which the bolts 7 that fix the cushioning body 1 to the cask 100 are inserted, respectively are provided in the impact absorber 4. These mounting holes 13 are expandable and contractable in a depth direction of the mounting holes 13 that is the direction orthogonal to the end surface 100*a* of the cask 100. The mounting holes 13 are provided coaxially with the locking holes 8 and the insertion holes 9. Bellows portions 14 are provided in the mounting holes 13. The bellows portions 14 cause the mounting holes 13 to deform in the direction orthogonal to the end surface 100*a* of the cask 100 with little resistance, when the cask 100 vertically drops or vertically collides.

As described above, in the cask cushioning body according to the present embodiment, the mounting holes 13 into which the bolts 7 that fix the cushioning body 1 to the cask 100 are inserted are provided in the impact absorber 4, and the mounting holes 13 are expandable and contractable in the depth direction of the mounting holes 13.

According to the cask cushioning body, it is possible to suppress a sudden increase in an impact load caused by deformations of the mounting holes 13 when the impact absorber 4 starts deforming at the time of the vertical drop or vertical collision of the cask 100. As a result, it is possible to suppress an excessive force from acting on the bolts 7 that fix the lid 105 to the main body 103 at the time of the vertical drop or vertical collision of the cask 100, thereby keeping the hermetically sealing performance by the metal gaskets.

REFERENCE SIGNS LIST

1 cushioning body
2 end-surface side member
21, 22 plate
23 opening
24 partition member
3 circumferential-surface side member
31 cylindrical body
31*a* stepped portion
4 impact absorber
5 end-surface reinforcing member
6 central reinforcing member
7 bolt
8 locking hole
9 insertion hole
10 protruding portion
11 flange portion
12 circumferential-surface reinforcing member

13 mounting hole
14 bellows portion
41 first impact absorber group
42 second impact absorber group
43 third impact absorber group
44 fourth impact absorber group
45 fifth impact absorber group
46 outer shell
100 cask
100*a* end surface
100*b* end-portion outer-circumferential surface
103 main body
104 bottom part
105 lid
105*a* primary lid
105*b* secondary lid
105*c* insertion hole
105*d* air-supply/exhaust, water-feed/drainage or pressure monitoring unit
109*a*, 109*b* bolt
110*a*, 110*b* bolt hole

The invention claimed is:

1. A cask cushioning body attached to both ends of a cask storing therein spent fuel and absorbing an impact applied to the cask, the cask cushioning body comprising:

an end-surface side member in which a plurality of plates made of steel are formed at a distance between plate surfaces of the plates that face each other, and in which the plate surfaces of the plates are arranged along an end surface of the cask; and a circumferential-surface side member that forms a cylindrical body made of the steel, one end of which is connected to a periphery of the end-surface side member, and that is arranged along an end-portion outer-circumferential surface of the cask, wherein an impact absorber that absorbs the impact by deforming is provided outside of the end-surface side member and the circumferential-surface side member;

the cask cushioning body is formed so that a size between an outer circumferential surface of a lid constituting the cask and an inner circumferential surface of the circumferential-surface side member is larger than a size between an outer circumferential surface of a main body of the cask to which the lid is fixed and the inner circumferential surface of the circumferential-surface side member.

2. The cask cushioning body according to claim 1, wherein the end-surface side member includes a plurality of end-surface reinforcing members provided to connect the plates to each other.

3. The cask cushioning body according to claim 1, wherein the end-surface side member includes at least one plate having an opening formed in a central portion thereof, and the end-surface side member includes a plurality of central reinforcing members in a region between the plate with the opening and the other plates.

4. The cask cushioning body according to claim 3, wherein the impact absorber is inserted into a region surrounded by the central reinforcing members and the plate provided with the opening.

5. The cask cushioning body according to claim 1, wherein the circumferential-surface side member includes a protruding portion in which peripheries of the plates in the end-surface side member protrude outward of the cylindrical body over an entire circumference of one end of the cylindrical body, a flange portion protruding outward over an entire circumference of other end of the cylindrical body, and a plurality of circumferential-surface reinforcing members connecting the protruding portion to the flange portion, and arranged on an outside surface of the cylindrical body.

6. The cask cushioning body according to claim 5, wherein the impact absorber is inserted into a region surrounded by the protruding portion, the flange portion, and the circumferential-surface reinforcing members.

7. The cask cushioning body according to claim 1, wherein a region of the end-surface side member in which the plates face each other covers a bolt for fixing the lid of the cask.

8. The cask cushioning body according to claim 7, the region of the end-surface side member in which the plates face each other covers an air-supply/exhaust, water-feed/drainage or pressure monitoring unit provided on the lid.

9. The cask cushioning body according to claim 1, wherein an impact absorbing material that absorbs the impact by deforming is filled in the end-surface side member between regions in which the plates face each other.

10. The cask cushioning body according to claim 1, wherein the impact absorber is formed by a combination of a plurality of wood blocks, and the impact absorber includes a first impact absorber group that is provided along a circumference of other end of the circumferential-surface side member, and that is made of a first material that absorbs the impact in a direction parallel to the end surface of the cask, a second impact absorber group that is provided around one end of the circumferential-surface side member, along the outer circumference of the end-surface side member, and adjacent to the first impact absorber group, and that is made of a second material that is lower in a compression strength than the first material and that absorbs the impact in the direction parallel to the end surface of the cask, a third impact absorber group that is provided in an external corner of the impact absorber along the outer circumference of the end-surface side member and adjacent to the second impact absorber group, and that is made of a third material that is lower in the compression strength than the second material and that absorbs the impact in a direction orthogonal to or inclined with respect to the end surface of the cask, a fourth impact absorber group that is provided along inner circumferences of the second and third impact absorber groups and adjacent to the second and third impact absorber groups, and that is made of the third material that absorbs the impact in the direction orthogonal to the end surface of the cask, and a fifth impact absorber group that is provided inside of a circumference of the fourth impact absorber group, and that is made of the third material that absorbs the impact in the direction parallel to the end surface of the cask.

11. The cask cushioning body according to claim 1, wherein a mounting hole into which a bolt for fixing the cushioning body to the cask is inserted is provided in the impact absorber, and the mounting hole is expandable and contractable in a depth direction of the mounting hole.

* * * * *